US005197202A

United States Patent [19]

Jensen

[11] Patent Number: 5,197,202

[45] Date of Patent: Mar. 30, 1993

[54] METHOD AND APPARATUS FOR DRYING AND CURING A COATED STRAND

[75] Inventor: Thomas H. Jensen, Murrysville, Pa.

[73] Assignee: PPG Industries, Inc., Pittsburgh, Pa.

[21] Appl. No.: 589,223

[22] Filed: Sep. 26, 1990

[51] Int. Cl.[5] ..... F26B 3/00

[52] U.S. Cl. ..... 34/23; 34/155; 34/231; 34/156

[58] Field of Search ..... 34/155, 10, 23, 231, 34/156; 432/59

[56] References Cited

U.S. PATENT DOCUMENTS

| | | | |
|---|---|---|---|
| 2,005,580 | 6/1935 | Ferre | 34/48 |
| 2,308,767 | 1/1943 | Mayes | 34/50 |
| 2,597,529 | 5/1952 | Redman | 34/155 |
| 3,619,252 | 11/1971 | Roscher | 117/66 |
| 3,680,218 | 8/1972 | Belue et al. | 34/10 |
| 3,750,302 | 8/1973 | Smith | 34/154 |
| 3,827,639 | 8/1974 | Relue et al. | 239/552 |
| 3,914,477 | 10/1975 | Belue et al. | 427/378 |
| 3,982,328 | 9/1976 | Gustafsson et al. | 34/156 |
| 4,121,350 | 10/1978 | Buchholz | 34/212 |
| 4,154,005 | 5/1979 | Pickering et al. | 34/155 |
| 4,218,830 | 8/1980 | Grassmann | 34/1 |
| 4,287,671 | 9/1981 | Koch, II | 34/27 |
| 4,292,745 | 10/1981 | Caratsch | 34/156 |
| 4,345,385 | 8/1982 | Sando et al. | 34/155 |
| 4,365,423 | 12/1982 | Arter et al. | 34/155 |
| 4,414,756 | 11/1983 | Simpson et al. | 34/23 |
| 4,475,294 | 10/1984 | Henricks | 34/155 |
| 4,498,250 | 2/1985 | Gageur et al. | 34/155 |
| 4,603,490 | 8/1986 | Hilmersson et al. | 34/155 |
| 4,622,761 | 11/1986 | Barth | 34/155 |
| 4,698,914 | 10/1987 | Shu et al. | 34/10 |
| 4,718,178 | 1/1988 | Whipple | 34/156 |
| 4,753,777 | 6/1988 | Yoshinari et al. | 422/150 |
| 4,762,750 | 8/1988 | Girgis et al. | 428/378 |
| 4,762,751 | 8/1988 | Girgis et al. | 428/378 |
| 4,863,761 | 9/1989 | Puri | 427/175 |
| 4,872,270 | 10/1989 | Fronheiser et al. | 34/23 |

FOREIGN PATENT DOCUMENTS

| | | |
|---|---|---|
| 3138637A1 | 4/1983 | Fed. Rep. of Germany . |
| 894237 | 4/1962 | United Kingdom . |

*Primary Examiner*—Henry A. Bennet
*Assistant Examiner*—Denise L. Gromada
*Attorney, Agent, or Firm*—Andrew C. Siminerio; Kenneth J. Stachel

[57] ABSTRACT

A plurality of coated strands are conveyed through a drying oven. A plurality of nozzles impinge the upper surface of the coated strand as it passes therethrough. Baffle plates positioned below the strands redirect the gas stream such that, after the gas stream has passed through the strands, it is redirected so as to impinge on an opposite surface of the coated strand.

19 Claims, 4 Drawing Sheets

METHOD AND APPARATUS FOR DRYING AND CURING A COATED STRAND

OBJECT OF THE INVENTION

1. Field of the Invention

This invention relates to drying coated glass fiber and in particular to drying coated strands of fiber glass filaments.

2a. Technical Considerations

Fiber glass, which was originally developed in the 1930s, has been used over the years as fibrous strand and yarns in numerous end uses, such as textiles, reinforcement polymeric matrices, and rubber goods. Glass fibers are traditionally produced through attenuation from small orifices in a bushing of a glass batch melting furnace. The glass fibers issue forth from the orifices in molten streams and are cooled and treated with a sizing composition. The sizing composition is ordinarily an aqueous composition having, e.g. coupling agents, lubricants and film-forming polymer components. The sized glass fibers are gathered into one or more bundles of fibers or strands and wound into a forming package or chopped. For textile applications, the bundles of fibers in the forming packages can be twisted and/or combined with other strands to form yarns. When the glass fibrous strands from the forming packages are used for reinforcement of rubber goods, a second chemical treatment or coating is usually applied to the strands to make the strands or bundles of strands compatible with the rubber matrix. In this latter application, the elastomer coating is generally applied by passing the strands through a vessel containing a solution or liquid dip containing the elastomer. The wet or saturated glass fiber strands are then supported and conveyed under slight tension over rollers or the like as they pass through a heated atmosphere to dry the elastomer coating. Some of the problems which arise with this type of drying arrangement include difficulties in processing the coated glass fiber strands over conveyor rolls, pulleys and the like without stripping off coating material and/or without depositing coating material on the conveying and supporting elements and maintaining the coated product cross section during the drying process. Contact with guides and support rolls may result in buildup of coating material on guides and supports which generally degrades of the coated product and may result in the coated fibers moving out of the guides and sticking together.

2b. Patents of Interest

U.S. Pat. No. 3,619,252 to Roscher discloses coating and impregnating glass fibers with an aqueous elastomer composition and then drying the coated product with high frequency electrical heaters to remove the water while not affecting the remaining elastomer solids. The coated fiber glass passes vertically through a dielectric heater where undesirable volatile constituents of the coating are removed. The strand then makes multiple passes through a hot gas oven to cure the coating.

U.S. Pat. Nos. 3,680,218 and 3,914,477 to Belue et al disclose a method of supporting and drying coated strands. The individual strands are exposed to jets of heated air from opposing slotted nozzles that are staggered relative to each other. The nozzles produce curtains of hot air on both sides of the strand that dry the coating while suspending the coated bundles between the nozzles.

SUMMARY OF THE INVENTION

The present invention provides a method and apparatus for drying and curing coated strands. The coated strands are conveyed through a drying oven which includes a recirculating hot gas system which directs a hot gas stream to impinge on a first side of the coated product and then redirects the gas stream by means of deflecting baffles to impinge on another side of the coated strands so as to increase turbulent heat transfer into the coated strands. In one particular embodiment of the invention, a plurality of nozzles are positioned along an upper plenum generally transverse to the direction in which the coated strand is conveyed through the drying oven. A plurality of baffles are positioned below the coated strands and aligned with a corresponding nozzle such that after the hot gas exits the nozzles and passes through the coated strands, the gas impinges on the baffle plates which in turn redirects the hot gas such that the gas impinges an opposite surface of the advancing strands.

DETAILED DESCRIPTION OF THE INVENTION

The present invention is disclosed in combination with drying strands of fiber glass filaments coated with polymeric chemical coatings, but it should be understood that the present invention can be used in any type of drying operation to improve drying efficiency and in particular, the invention may be used to dry any elongated member, such as e.g., strands, yarns, cords or the like.

Although not limiting in the present invention, in the particular embodiment discussed herein, the glass fibers are produced from any fiberizable glass batch composition and formed into glass fibers such as "E-glass" fibers, "621 glass" fibers, "A-glass" fibers, "S-glass" fibers, "C-glass" fibers and low fluorine and/or boron derivatives thereof. However, other coated materials such as carbon, graphite, nylon, polyester, polyaramid, steel and the like may be dried in accordance with the teachings of the present invention. The glass fibers are drawn from orifices in a bushing of a glass batch melting furnace and when they have cooled sufficiently, a sizing composition can be applied to them. The glass fibers can be mechanically attenuated or prepared by any other method known to those skilled in the art. The sizing composition can be applied to the glass fibers by any method known to those skilled in the art, such as belts, rollers, sprays and the like. The sizing composition may have present one or more of the following components; a coupling agent and a fiber protectorant, where the protectorant can be a fiber lubricant or a fiber film-former. The film-former can be a polymeric material that forms a film upon the evaporation of a carrier or upon drying forms a liquid film or by any other film-forming mechanism known to those skilled in the art. Also, for glass fibers and other types of fibers, additional ingredients like friction-reducing agents and/or antistatic agents may be present. Any coupling agent, fiber lubricant or fiber film-forming polymer known to those skilled in the art can be used. A non-exclusive example of a suitable aqueous sizing composition for glass fibers is that disclosed in U.S. Pat. No. 4,390,647 to Girgis, which teachings are hereby incorporated by reference. For glass fibers, the sized glass fibers are gathered into bundles or strands of glass fibers containing from 200 to over 3,000 filaments. The strands are collected, usually by winding onto a forming package or into a precision wound package of roving.

Figure 1:
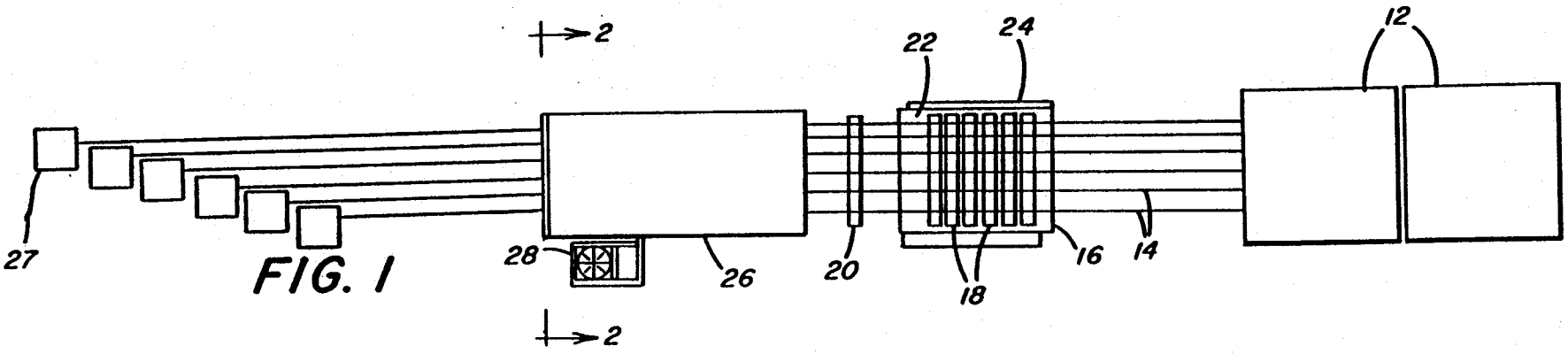
FIG. 1 is a plan view of a fiber coating and drying arrangement incorporating features of the present invention.

Referring to FIG. 1, a creel 12 includes a plurality of bobbins or forming packages (not shown) containing fiber glass strand 14. Each of the fiber glass strands 14 have been coated with a sizing composition containing a lubricant, binder and coupling agent. In the case of drawing the strand from bobbins, each strand 14 has imparted therein a twist to provide strand integrity and resistance to fuzzing during the initial handling and processing prior to being coated and impregnated with an elastomeric material.

The strands 14 are drawn from the packages in creel 12 in parallel relations and passed through a guide 16 in tangent contact across motor driven rotating rollers or dip applicators 18 to a motor driven rotating wiper roller or guide 20. The dip applicators 18 are partially suspended in an aqueous rubber dip or emulsion 22 contained within vessels or tanks 24. Although not limiting in the present invention, the emulsion may be of the type disclosed in U.S. Pat. Nos. 4,663,231; 4,762,750 and 4,762,751 to Girgis et al., which teachings are hereby incorporated by reference. The dip applicators 18 are driven counter to the direction of travel of the strand 14 to improve the coating and impregnation thereof. The pickup of the rubber dip 22 by the applicators 18 and strand 14 is more than sufficient to coat and impregnate the strands 14 with the desired final amount of rubber dip 22. The wiper roller or guide 20 is driven counter to the direction of travel of the strand 14 and serves to further impregnate the strand and/or removing excess rubber dip 22 from the coated strand 14.

After coating, the strand 14 enters drying oven 26. If desired, several coated strands can be combined to form a larger bundle and, if necessary, be drawn through a forming die (not shown) to combine and form the bundle as well as remove excess coating material. After drying and curing, the coated strands 14 are wound onto a series of Lessona winders 27 or any other type of strand storing device known in the art, e.g., spindles or a textile winding frame.

Figure 2:
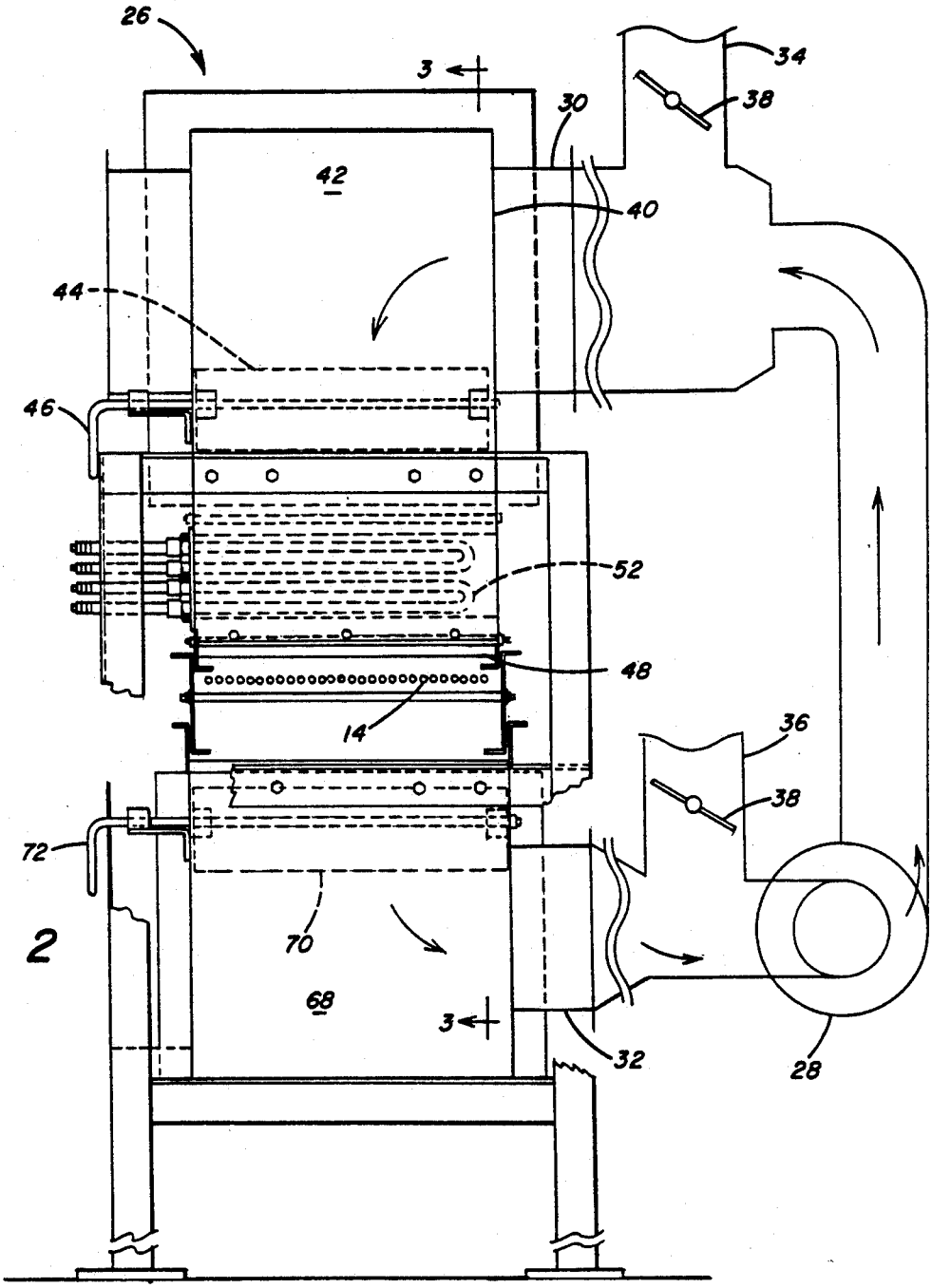
FIG. 2 is an end view along line 2—2 of FIG. 1 showing the drying oven the present invention.
Figure 3:
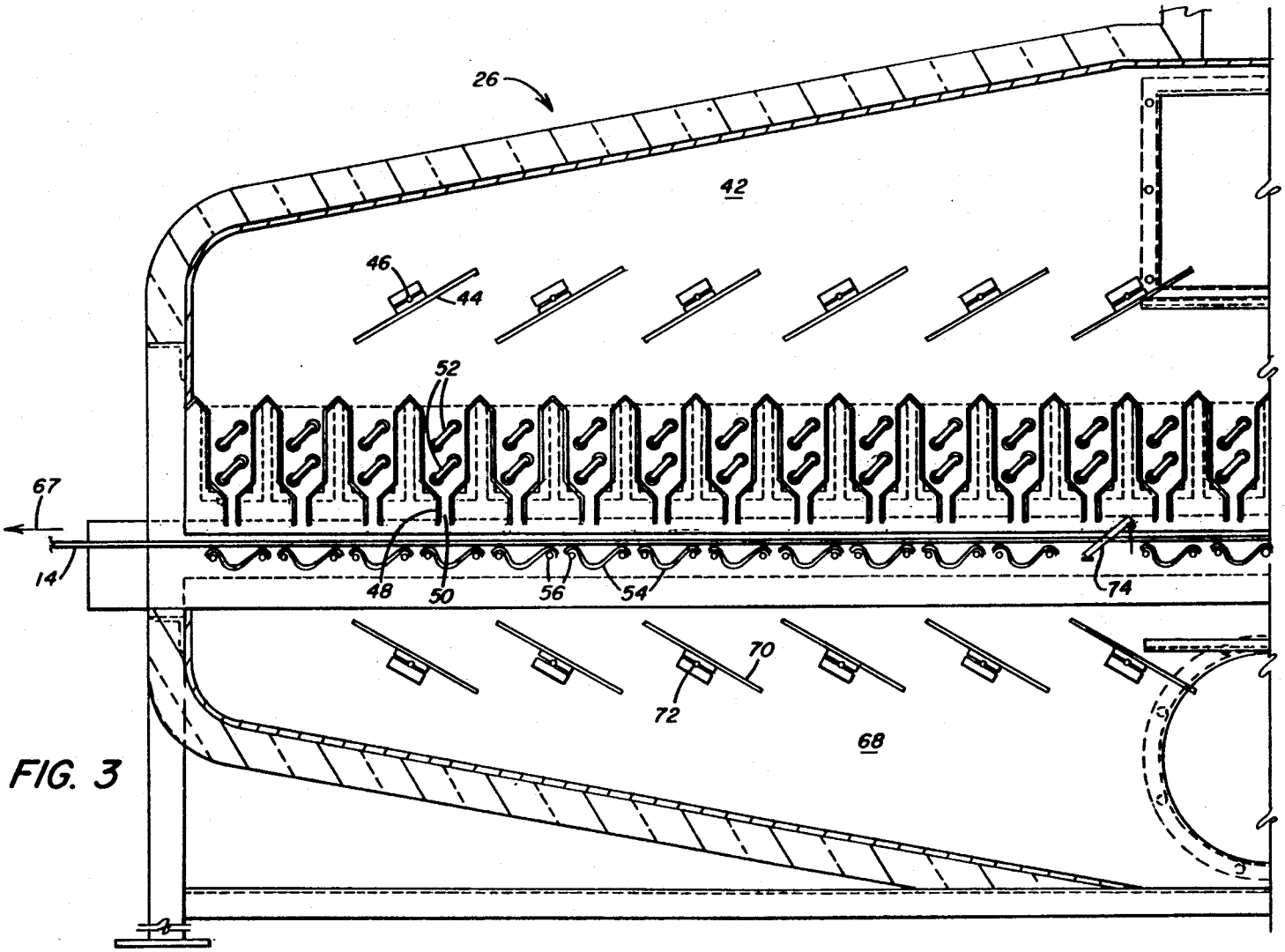
FIG. 3 is an enlarged elevational view through line 3—3 of FIG. 2, with portions removed for clarity.

Referring to FIGS. 2 and 3, and as will be discussed later in more detail, the strands 14 progress through the oven 26 which utilizes recirculating hot air or gas which is directed through nozzles to deliver a higher velocity gas stream which impacts one side of the coated strand 14. The gas is then redirected back onto the opposite side of the strand 14 by deflector baffles which increase the turbulent heat transfer and improve drier efficiency. Specifically referring to FIG. 2, blower 28 circulates gas, preferably air, through oven inlet duct 30, oven 26 and oven outlet duct 32. Air intake duct 34 is positioned along inlet duct 30 and air outlet duct 36 is positioned along outlet duct 32 to provide a means to add or remove recirculating air to the system. In addition, air circulation control plates 38 are positioned within ducts 30 and 32 to further control the air flow therethrough.

Air enters the oven 26 through inlet 40 of upper plenum 42. Deflector plates 44 are secured to pivotable baffle rods 46 positioned within the upper plenum 42 to direct and distribute the incoming air to a plurality of nozzles 48. Although not limiting in the present invention in the particular embodiment illustrated in FIGS. 2 and 3, the nozzles 48 are positioned generally perpendicular and transverse to the direction of travel of the coated strands 14 through the oven 26. The lower end of the nozzles 48 preferably include a slotted opening 50 that is adjustable so as to vary the width of the nozzle opening and help control the volume and velocity of air delivered by the upper plenum 42. Nozzles 48 direct high velocity air at the upper surface of the advancing strand 14.

Although not limiting in the present invention, a plurality of heating elements 52 extend into the upper plenum 42 to heat the air prior to it being expelled through the nozzles 48. In the particular embodiment illustrated in FIGS. 2 and 3, the elements 52 are electrical resistance heaters which are positioned such that the air must pass over and/or around the elements 52 to heat the moving air. As an alternative, hot gas can be supplied to the upper plenum 42 of the oven 26 from an external gas heating source (not shown).

Figure 4:
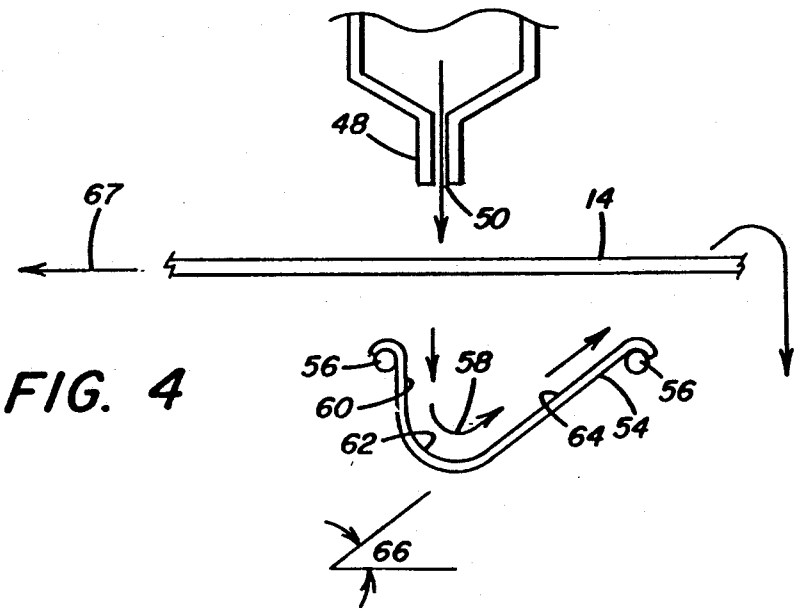
FIG. 4 is an enlarged view of the nozzle and baffle plate arrangement shown in FIG. 3.

Referring to FIGS. 3 and 4, below the coated strand 14, a plurality of curvilinear baffle plates 54 are supported on rods 56 and extend the width of the oven 26 to enhance heat transfer between the coated strand 14 and the heated air. The plates 54 alter the flow of air from the nozzles 48 and redirect it so that it impacts the lower surface of the strand 14 as indicated by arrows 58 (shown in FIG. 4 only). More particularly, baffle plates 54 are positioned below each nozzle opening 50 such that air from the nozzle 48, after impinging on and passing through the advancing strands 14, is redirected by the curvilineal surface of plate 54 such that the high velocity air turns from a downward direction to an upward direction and impacts the strand 14 a second time. The smooth, continuous surface of baffle plate 54 redirects the air with a minimum amount of air loss and turbulence to the air stream. Although not limiting in the present invention, surface portion 60 of plate 54 is preferably tangent to the air flow as it exits the nozzle 48. In the particular embodiment illustrated in FIG. 3, the nozzles 48 direct air downward in a vertical direction so that portion 60 is oriented in a vertical direction. Surface portion 62 of plate 54 is curved and serves to alter the vertically downward direction of the air. Surface portion 64 directs the air at a desired angle to impinge the opposite side of the coated strand 14. Angle 66 of surface portion 64 is preferably within a range of 30° to 50° and in the particular embodiment illustrated in FIG. 3, angle 66 is 45°. In addition, baffle plates 54 are preferably oriented so that the redirected air flow has a component that is parallel to but in the opposite direction from the advancing coated strand 14 indicated by arrow 67. After passing over baffle plate 54 and impinging on the coated strand 14, the heated gas is drawn out of the oven 26 through lower plenum 68. Additional deflector plates 70 and adjusting rods 72 are positioned within the lower plenum 68 to control and adjust the air flow therethrough.

Figure 5:
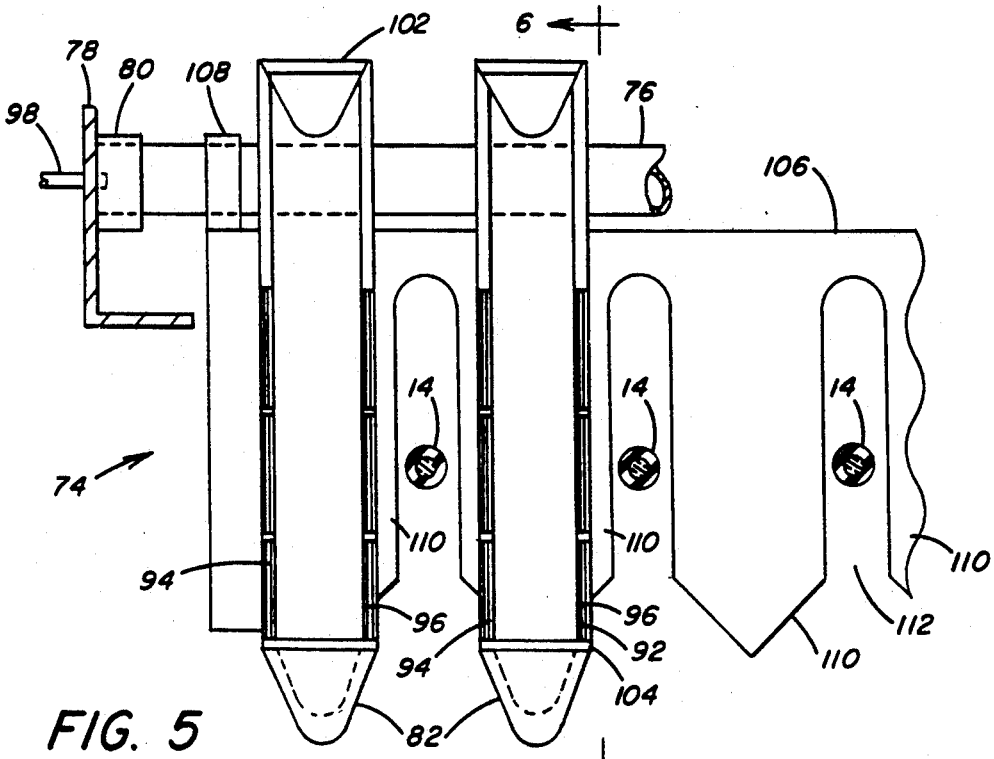
FIG. 5 is a partial elevational view taken along line 5—5 of FIG. 3 showing the coated strand support arrangement.

When the drying oven 26 of the present invention is oriented such that the strand 14 passes therethrough in a horizontal direction, additional means are required to support the strand 14 to reduce sagging of the strand during drying. If desired, support rolls (not shown) may be positioned along the path of the strand to support it as it advances through the oven 26. However, since such rolls must physically contact the strand 14 to provide the desired support, this contact may change the shape of the coated strand 14 and/or remove some of the coating from the strand 14, resulting in buildup of the coating at the contact points. Therefore, it is preferred that the strand be supported by a non-contact strand support assembly 74. Although not limiting in the present invention, in the particular embodiment of the support assembly 74 illustrated in FIGS. 5–7, the support assembly 74 includes an air supply header 76 which is pivotally mounted from support member 78 by collar assembly 80 such that it is positioned above and generally transverse to the coated strands 14. A plurality of nozzle assemblies 82 extend downwardly from the header 76 in a generally spaced apart and parallel orientation to provide clearance therebetween for each strand 14. Although not limiting in the present invention, each nozzle assembly 82 includes a pair of U-shaped members 84 and 86. Header 76 is scalloped to receive member 86, which is secured to the header 74 so as to hold the assembly 82 in place. The spacing between legs 88 of member 84 is slightly less than the spacing between legs 90 of member 86 so that when the members are mated and secured to each other as shown in FIG. 7, a narrow gap provides a nozzle opening 92 between each pair of adjacent legs, forming a pair of nozzles 94 and 96. The width of the nozzle opening 92 is generally between 0.010 and 0.020 inches (0.25 to 0.50 mm) depending on the material being dried and the volume of air provided through header 76. Although not limiting in the present invention, in one particular embodiment, the width of opening 92 was 0.020 in (0.50 mm) and the air flow through the support assembly 74 was 20 to 40 CFM (0.57 to 1.13 $m^3$ per min). Air provided from a pressurized air source (not shown) is pumped through fitting 98 at collar assembly 80 into header 76. The pressurized air then passes through opening 100 in lower U-shaped member 86 and into the nozzle assemblies 82. Plates 102 and 104 seal the front and back of each nozzle assembly 82.

The nozzle assemblies 82 are inclined relative to the strand 14 and nozzles 94 and 96 from adjacent nozzle assemblies 82 are inclined relative to each other such that a curtain of air from nozzle 94 of one nozzle assembly 82 intersects a curtain of air from nozzle 96 of adjacent nozzle assembly 82 along a line that generally lies in the same plane as any vertical movement of the strand 14 as it is conveyed through the drying oven 26. Any lateral force applied to the strand 14 by one nozzle will be opposed by equal lateral force exerted by an adjacent nozzle on an adjacent nozzle assembly. In addition, the vertical forces from the air stream will be additive. In this manner, the air streams will tend to lift and support the strand 14 as it is conveyed through the oven 26 as well as tend to maintain any movement of the strand in a generally vertical plane parallel to the direction in which a strand is being conveyed through oven 26.

The length, L, of the nozzle opening 92 is a function of the angle, A, of the nozzle assembly 82 and the anticipated vertical movement, V, of the strand 14 as it is conveyed through the oven 26. In practice, length L is preferrably slightly greater than V/sin A. In the preferred embodiment of the invention, angle A is 45° so that length L is slightly greater than 1.41V. Nozzle openings 92 outside the preferred length can be sealed, for example, by welding. In addition, it is preferred that the support assembly 74 is positioned such that the nozzle openings 92 are centered along the midpoint of the expected vertical movement V of the strand 14.

Figure 6:
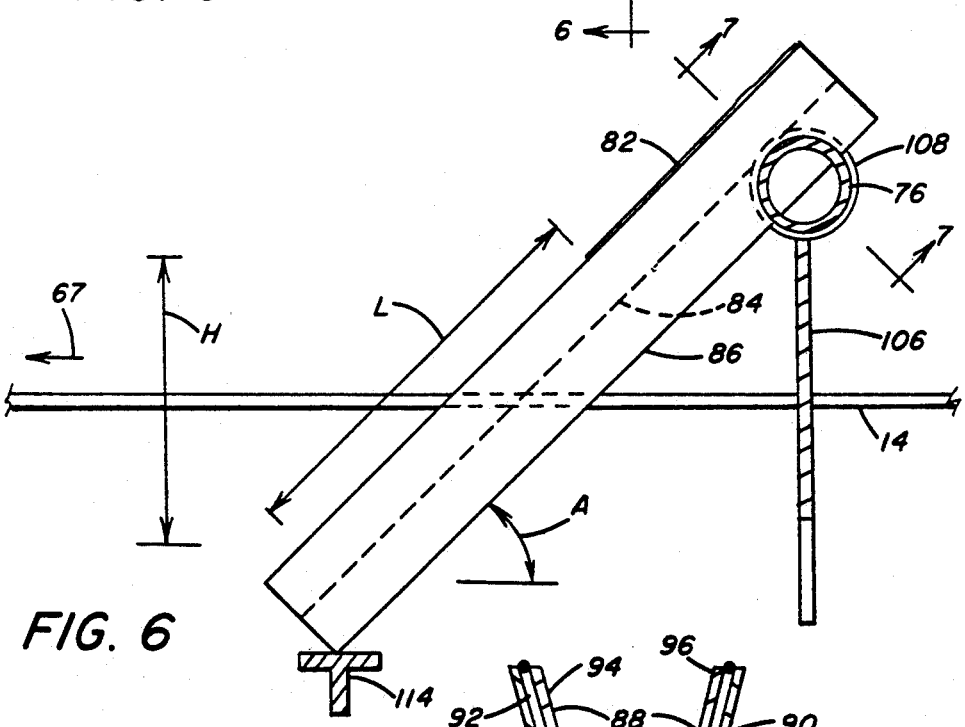
FIG. 6 is a view through line 6—6 of FIG. 5 with portions removed for clarity.
Figure 7:
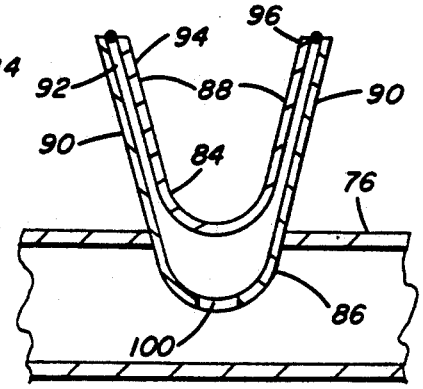
FIG. 7 is a view taken along line 7—7 of FIG. 6 with portions removed for clarity.

Referring to FIGS. 6 and 7, an alignment plate 106 is pivotally hung from header 76 via collars 108 and is used to maintain strand alignment when the oven 26 is being rethreaded with strand 14. In particular, the plate 106 includes a plurality of spaced apart fingers 110 which are aligned with a corresponding nozzle assembly 82 such that the space 112 between pairs of fingers 110 corresponds to the space between each nozzle assembly 82 and thus the location of the strand 14 as it is conveyed through the oven 26. In practice during a rethreading operation, a rethreading bar (not shown) with the strands 14 attached thereto at their preferred spacing, is passed through the oven 26 from right to left as viewed in FIG. 1. As the bar reaches the support assembly 74, it lifts and pivots first alignment plate 106 and then nozzle assemblies 82 upward and out of the way of the bar. Referring to FIG. 6, this would be a clockwise rotation about header 76. As the bar continues through the oven 26, it passes the plate 106 allowing it to swing back into position while still lifting the nozzle assemblies 82. The fingers 110 maintain the aligned position of the strands 14 at the support assembly until the bar passes the nozzle assemblies 82 allowing them to fall back into place to their original position. A stop member 114 is positioned to limit the downward rotation of the nozzle assemblies in support assembly 74.

It should be appreciated by one skilled in the art that other methods may be used to provide a non-contact support for the strand. For example, an air knife assembly (not shown) may be positioned below the coated strands 14 to deliver an upwardly directed sheet of air to support the strands 14, as is known in the art. In addition, the air knife assemblies may also include vertical comb members positioned between adjacent coated strands 14 to maintain the individual strands 14 in spaced apart relationship from each other as they advance through the oven 26 and prevent uncured product which may still have a tacky surface from sticking to other coated strands.

As an alternative to using rolls or air to support the coated strand, depending on the type of product, tension may be applied to the coated strand 14 to support it as it advances through the oven 26.

In one particular embodiment of the invention, coated strands were dried using two 10-foot long ovens of the type shown in FIGS. 2 and 3 and as previously discussed. Each oven included 30 nozzles with 0.5 inch (1.27 cm) wide nozzle openings. Strand speed varied from 45 to 300 feet per minute (14 to 92 meters per minute) depending on the strand and the coating thickness. Minimum coated strand spacing was set at 0.75 inches (1.91 cm). Air was delivered through the nozzle openings at a speed of 2,000 to 5,000 feet per minute (610 to 1,524 meters per minute) and at a temperature between 400° F. to 700° F. (204° C. to 371° C.) and preferably at 3,000 to 4,000 feet per minute (915 to 1,220 meters per minute) and 500° F. to 600° F. (260° C. to 316° C.). It was found that coated strands processed by these ovens dried and cured at a rate approximately four times faster than conventional hot air ovens.

The form of the invention shown and described in this disclosure represents an illustrative preferred embodiment thereof. It is understood that various changes may be made without departing from the teachings of the invention defined by the claimed subject matter which follows.

I claim:

1. A method of drying a coated strand comprising:
conveying a coated strand in a generally linear horizontal direction;
directing a plurality of high velocity, heated gas streams passed said strand to impact the upper surface of said strand;
redirecting said gas streams upon passing said strands so as to immediately impact the lower surface of said coated strand whereby said redirected gas stream has a component parallel to said strand in a direction opposite to the conveyed direction of said strand; and
supporting said strands at locations intermediate of their ends during said conveying, impacting and redirecting steps by directing additional streams of gas upward against said lower surfaces of said strands to support said strands.

2. The method as in claim 1 wherein said conveying step includes conveying a plurality of coated strands in parallel, spaced apart orientation.

3. The method of claim 2 further including the step of recirculating at least a portion of said gas stream after said redirecting step and practicing said impacting and redirecting step in part with said recirculated gas.

4. The method as in claim 2 wherein said redirecting step further includes the step of directing said gas streams such that they impact said second side of said strand at an acute angle relative to such strand.

5. The method as in claim 4 wherein said second side is the side of said strand opposite said first side.

6. The method as in claim 4 wherein said redirecting step directs said gas stream at an angle 45° relative to said coated strand.

7. The method as in claim 2 wherein said redirecting step further includes the step of directing said gas stream such that it has a component parallel to said strand in a direction opposite to the conveyed direction of said strand.

8. The method as in claim 7 wherein said coated strand is conveyed in a horizontal direction and said first side of said strand is its upper surface and said second side is its lower surface.

9. The method of claim 8 further including the step of supporting said strands at locations intermediate of its ends during said conveying, impacting and redirecting steps.

10. The method as in claim 9 wherein said supporting step includes directing additional streams of gas upward against said lower surface of said strand to support said strand.

11. The method as in claim 10 wherein said redirecting step further includes the step of directing said gas stream such that it has a component parallel to said strand in a direction opposite to the conveyed direction of said strand.

12. The method of claim 11 further including the step of recirculating at least a portion of said gas stream after said redirecting step and practicing said impacting and redirecting step in part with said recirculated gas.

13. An apparatus for drying a coated strand comprising:
a first plenum;
a second plenum;
means to introduce heated gas into said first plenum and remove said heated gas from said second plenum;
means to convey coated strand between said plenums;
a plurality of nozzles positioned generally transverse to the direction of said strand conveyance to direct the heated gas from said first plenum to impact a first side of said coated strand; and
a plurality of baffle plates positioned between said plenums such that said strand is conveyed between said baffle plates and said nozzles, wherein each of said baffle plates is aligned with a corresponding nozzle to redirect the heated gas to subsequently impact a second side of said coated strand, and wherein said baffle plates include a first surface portion to receive said heated gas after it has initially passed between said strands and impacted said strands' first surface, a second curvilinear portion to redirect said gas stream and a third surface portion which is at an acute angle relative to said coated strand to guide said gas stream against said second side of said strand.

14. The apparatus as in claim 13 wherein said first surface portion of said baffle plate is parallel to said directed gas stream.

15. The apparatus as in claim 13 wherein said conveying means conveys said strand in a generally horizontal direction, said first and second sides of said strand are its upper and lower surfaces, respectively, and said first and second plenum are upper and lower plenums, respectively.

16. The apparatus as in claim 15 further including means to support said strand within said lower plenum.

17. The apparatus as in claim 16 wherein said support means includes means to direct additional gas streams upward against said lower surface of said strand to support said strand.

18. The apparatus as in claim 16 further including means to recirculate at least a portion of gas removed from said lower plenum into said upper plenum.

19. The apparatus as in claim 18 wherein said first surface portion of said baffle plate is parallel to said directed gas stream and said third surface portion of said baffle plate is at as acute angle relative to said coated strand.

* * * * *